US010990058B1

(12) United States Patent
Kano et al.

(10) Patent No.: US 10,990,058 B1
(45) Date of Patent: Apr. 27, 2021

(54) CLEANING BODY, ASSEMBLY, AND IMAGE FORMING APPARATUS

(71) Applicant: FUJI XEROX CO., LTD., Tokyo (JP)

(72) Inventors: Fuyuki Kano, Kanagawa (JP); Yasuhiko Kinuta, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/945,931

(22) Filed: Aug. 2, 2020

(30) Foreign Application Priority Data

Mar. 26, 2020 (JP) ..... JP2020-056879

(51) Int. Cl.
*G03G 21/00* (2006.01)

(52) U.S. Cl.
CPC ..... *G03G 21/0017* (2013.01)

(58) Field of Classification Search
CPC ..... G03G 21/0017
See application file for complete search history.

(56) References Cited

U.S. PATENT DOCUMENTS 8,538,287 B2 9/2013 Kawai
2013/0259513 A1* 10/2013 Kawai ..... G03G 15/0258 399/100
2017/0123338 A1* 5/2017 Kano ..... G03G 15/0258

FOREIGN PATENT DOCUMENTS

JP H02272594 11/1990
JP 2012014011 1/2012

* cited by examiner

*Primary Examiner* — Susan S Lee
(74) *Attorney, Agent, or Firm* — JCIPRNET

(57) ABSTRACT

A cleaning body includes a core and a foamed elastic layer spirally wound around an outer circumferential surface of the core from one end of the core to the other end. An end portion of a cell skeleton protruding from a surface of the foamed elastic layer has an equivalent circle diameter of 50 μm or less. The foamed elastic layer has a spiral pitch R2 of 5 mm or less and a spiral angle θ of 15° or less.

15 Claims, 10 Drawing Sheets

CLEANING BODY, ASSEMBLY, AND IMAGE FORMING APPARATUS

CROSS-REFERENCE TO RELATED APPLICATIONS

This application is based on and claims priority under 35 USC 119 from Japanese Patent Application No. 2020-056879 filed Mar. 26, 2020.

BACKGROUND

(i) Technical Field

The present disclosure relates to a cleaning body, an assembly, and an image forming apparatus.

(ii) Related Art

Japanese Unexamined Patent Application Publication No. 02-272594 discloses an image forming apparatus including an image carrier and a contact-type elastic charging unit that comes into pressure contact with the image carrier and applies a bias voltage to the image carrier and/or a transfer medium. A cleaning unit made of sponge material abuts against the elastic charging unit.

Japanese Unexamined Patent Application Publication No. 2012-014011 discloses a cleaning member for an image forming apparatus. The cleaning member includes a core and an elastic layer disposed by spirally winding a strip-shaped elastic member around the outer circumferential surface of the core. The cleaning member satisfies the relationship of $0.7<t/T<1.0$ where t represents the thickness (mm) of a central portion of the elastic layer in the spiral width direction while the elastic layer is wound around the outer circumferential surface of the core, and T represents the thickness (mm) of a central portion of the strip-shaped elastic member in the width direction before the strip-shaped elastic member is wound around the outer circumferential surface of the core.

SUMMARY

Aspects of non-limiting embodiments of the present disclosure relate to a cleaning body including a core and a foamed elastic layer spirally wound around an outer circumferential surface of the core from one end of the core to the other end. The cleaning body has higher cleaning maintainability against a body to be cleaned than a cleaning body in which an end portion of the cell skeleton protruding from the surface of the foamed elastic layer has an equivalent circle diameter of more than 50 μm or the foamed elastic layer has a spiral pitch R2 of more than 5 mm or a spiral angle θ of more than 15°, or a cleaning body in which the spiral pitch R2 and the spiral angle θ do not satisfy the relationship of $0.2 \leq R2/\theta \leq 1.0$.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a cleaning body including a core and a foamed elastic layer spirally wound around an outer circumferential surface of the core from one end of the core to the other end, wherein an end portion of a cell skeleton protruding from a surface of the foamed elastic layer has an equivalent circle diameter of 50 μm or less, and the foamed elastic layer has a spiral pitch R2 of 5 mm or less and a spiral angle θ of 15° or less.

BRIEF DESCRIPTION OF THE DRAWINGS

Exemplary embodiments of the present disclosure will be described in detail based on the following figures, wherein.

DETAILED DESCRIPTION

Figure 1:
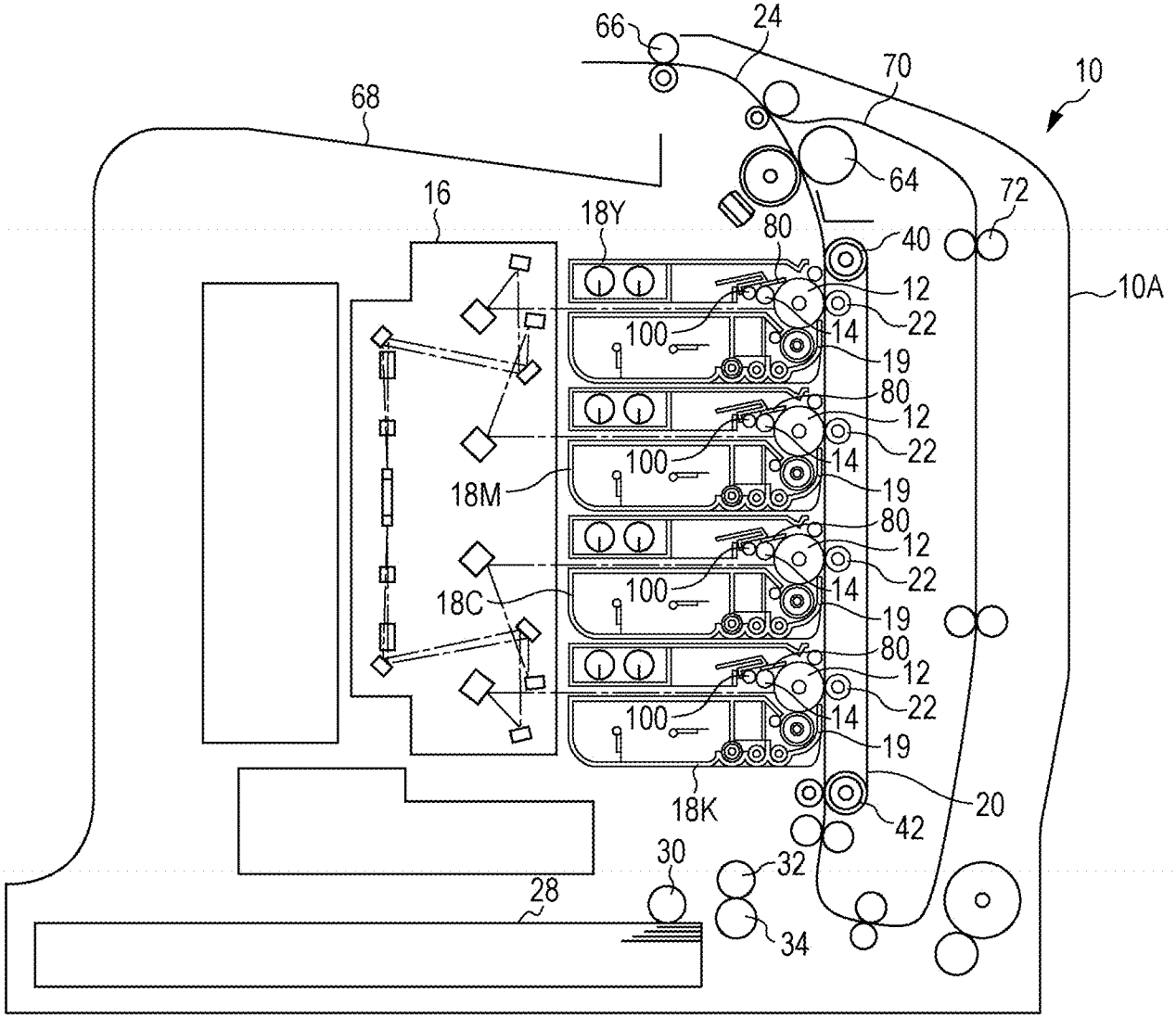
FIG. 1 is a schematic view of an example electrophotographic image forming apparatus according to an exemplary embodiment.

Exemplary embodiments according to the present disclosure will be described below with reference to the drawings. The following description and Examples are provided to illustrate exemplary embodiments, but are not intended to limit the scope of the present disclosure. It is noted that components having the same function and the same operation may be provided with the same reference symbol throughout all the drawings, and the description thereof may be omitted.

The upper limit or the lower limit of one numerical range in stepwise numerical ranges in this specification may be replaced by the upper limit or the lower limit of another stepwise numerical range. The upper limit or the lower limit of any numerical range described in this specification may be replaced by the values described in Examples.

In this specification, the term "step" not only includes an independent step but also includes a step that cannot be clearly distinguished from other steps but accomplishes the intended purpose.

Each component may contain multiple corresponding substances.

The amount of each component in a composition refers to, when there are multiple substances corresponding to each component in the composition, the total amount of the substances present in the composition, unless otherwise specified.

A cleaning body according to a first exemplary embodiment includes a core and a foamed elastic layer (hereinafter may be referred to simply as an "elastic layer") spirally wound around the outer circumferential surface of the core from one end of the core to the other end.

An end portion of a cell skeleton protruding from the surface of the foamed elastic layer has an equivalent circle diameter of 50 μm or less, and the foamed elastic layer has a spiral pitch R2 of 5 mm or less and a spiral angle θ of 15° or less.

The cleaning body according to the first exemplary embodiment has high cleaning maintainability due to the foregoing features. The reason for this is assumed as described below.

When the end portion of the cell skeleton protruding from the surface of the foamed elastic layer has an equivalent circle diameter of 50 μm or less, the cleaning body may exhibit a high ability to remove contaminants attached to a body to be cleaned from an area with a rough surface and an area with a narrow recess width in the body to be cleaned and thus can effectively remove contaminants, resulting in high cleaning performance. The end portion of the cell skeleton protruding from the surface of the foamed elastic layer is unlikely to be wore out even after repeated cleaning, and the cleaning body may thus have high cleaning maintainability.

When the foamed elastic layer has a spiral pitch R2 of 5 mm or less and a spiral angle θ of 15° or less, the load of winding deformation on the foamed elastic layer may be reduced. The foamed elastic layer is unlikely to deform accordingly even after repeated cleaning.

The cleaning body according to the first exemplary embodiment may thus have high cleaning maintainability.

A cleaning body according to a second exemplary embodiment includes a core and a foamed elastic layer (hereinafter may be referred to simply as an "elastic layer") spirally wound around the outer circumferential surface of the core from one end of the core to the other end.

An end portion of a cell skeleton protruding from the surface of the foamed elastic layer has an equivalent circle diameter of 50 μm or less, and the spiral pitch R2 and the spiral angle θ of the foamed elastic layer satisfy the relationship of $0.2 \leq R2/\theta \leq 1.0$.

The cleaning body according to the second exemplary embodiment has high cleaning maintainability due to the foregoing features. The reason for this is assumed as described below.

When the end portion of the cell skeleton protruding from the surface of the foamed elastic layer has an equivalent circle diameter of 50 μm or less, the cleaning body can effectively remove contaminants, resulting in high cleaning performance. The end portion of the cell skeleton protruding from the surface of the foamed elastic layer is unlikely to be wore out even after repeated cleaning, and the cleaning body may thus have high cleaning maintainability.

When the spiral pitch R2 and the spiral angle θ of the foamed elastic layer satisfy the relationship of $0.2 \leq R2/\theta \leq 1.0$, the load of winding deformation on the foamed elastic layer may be reduced. The foamed elastic layer is unlikely to deform accordingly even after repeated cleaning.

The cleaning body according to the second exemplary embodiment may thus have high cleaning maintainability.

The details of the exemplary embodiments will be described below with reference to the drawings.

Image Forming Apparatus 10

An image forming apparatus according to an exemplary embodiment will be described.

FIG. 1 is a schematic view of an example of the image forming apparatus according to the exemplary embodiment, which is an electrophotographic image forming apparatus.

Figure 2:
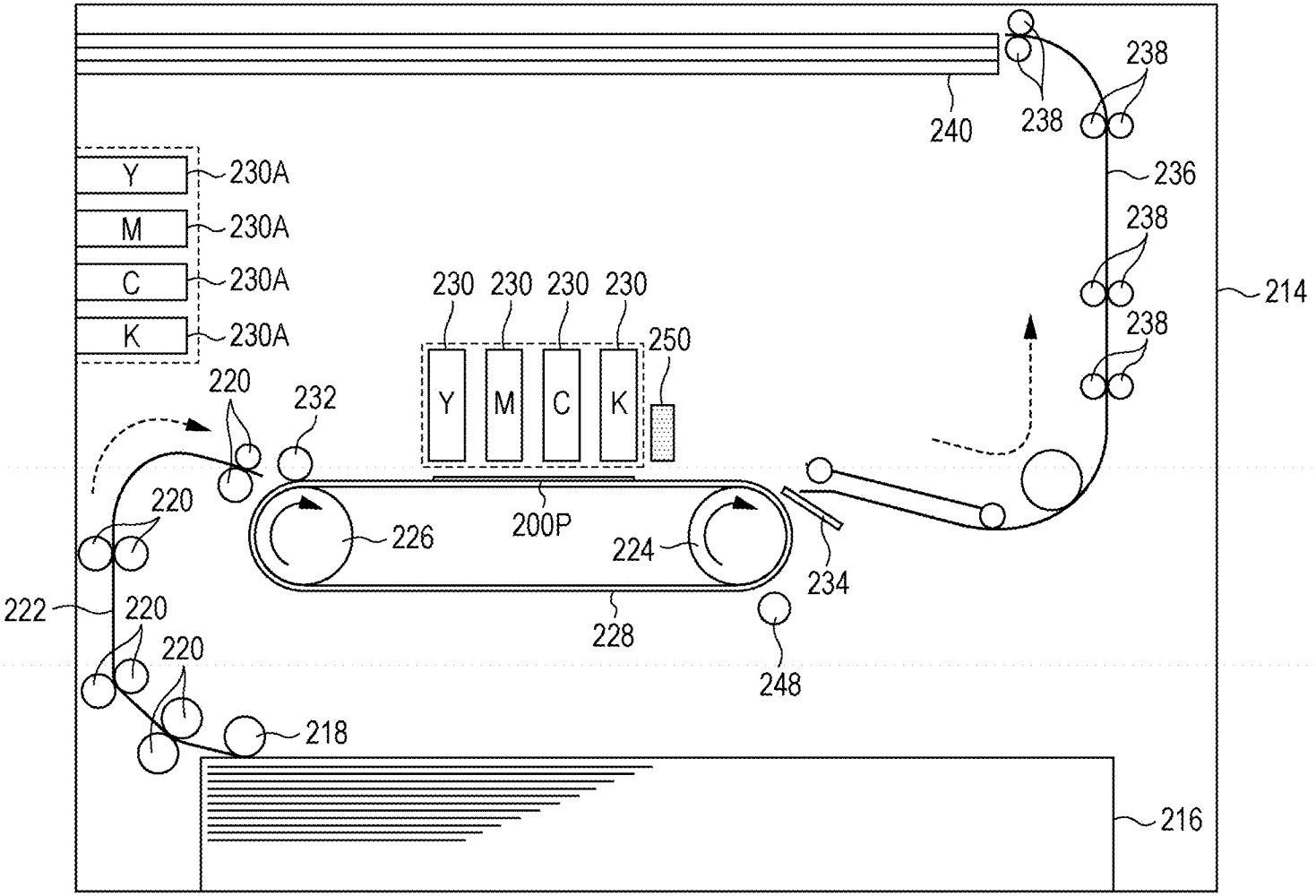
FIG. 2 is a schematic view of an example ink-jet image forming apparatus according to an exemplary embodiment.

FIG. 2 is a schematic view of an example of the image forming apparatus according to the exemplary embodiment, which is an ink-jet image forming apparatus.

An image forming apparatus 10 illustrated in FIG. 1 is an example electrophotographic image forming apparatus. Specifically, the image forming apparatus 10 is an electrophotographic image forming apparatus that forms a toner image (example image) on a recording medium 24. More specifically, the image forming apparatus 10 is an image forming apparatus of the tandem system as illustrated in FIG. 1 and has the following structure.

The image forming apparatus 10 has an apparatus body 10A. The apparatus body 10A contains process cartridges 18Y, 18M, 18C, and 18K (hereinafter collectively referred to as process cartridges 18), which respectively correspond to yellow (Y), magenta (M), cyan (C), and black (K).

Figure 4:
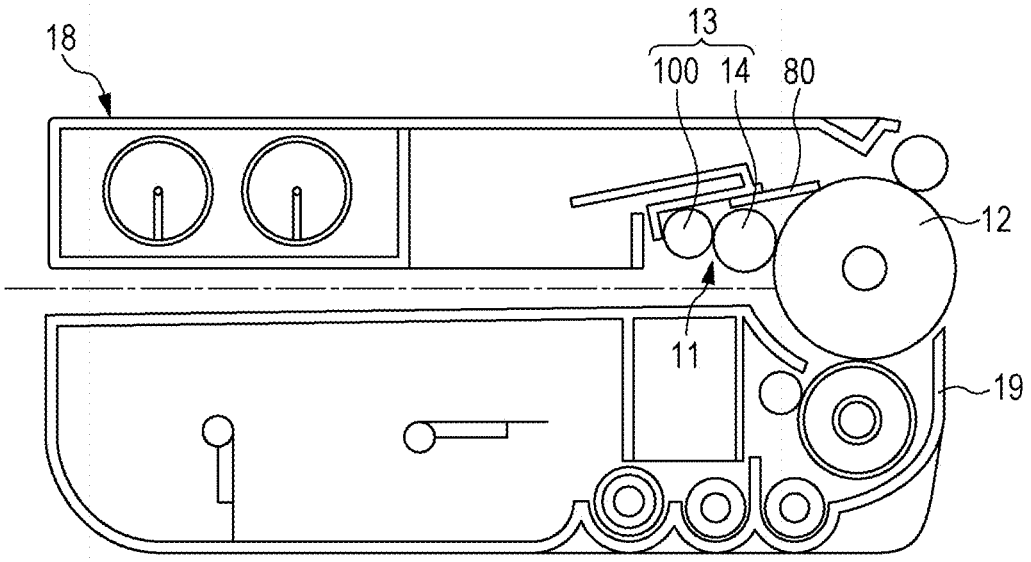
FIG. 4 is a schematic view of an example process cartridge according to an exemplary embodiment.

As illustrated in FIG. 4, each process cartridge 18 includes a photoreceptor 12 (an example image carrier, an example body to be charged), which can carry an image, a charging device 11, which has a charging member 14 (example charging body), and a developing device 19. Each process cartridge 18 is attachable to and detachable from the apparatus body 10A illustrated in FIG. 1 and functions as an example assembly assembled so as to be integrally attachable to and detachable from the apparatus body 10A. Each assembly according to the exemplary embodiment includes at least the photoreceptor 12 and the charging device 11. The detailed structure of the charging device 11 in the process cartridge 18 will be described below.

The surface of the photoreceptor 12 illustrated in FIG. 1 is charged by the charging member 14 and then subjected to image exposure with a laser beam emitted from an exposure device 16 to form an electrostatic latent image according to image information. The electrostatic latent image formed on the photoreceptor 12 is developed by the developing device 19 to form a toner image.

For example, in the case of forming a color image, the surfaces of the photoreceptors 12 for respective colors are subjected to the charging, exposing, and developing steps corresponding to yellow (Y), magenta (M), cyan (C), and black (K) colors to form toner images corresponding to yellow (Y), magenta (M), cyan (C), and black (K) colors on the surfaces of the photoreceptors 12 for respective colors.

The toner images corresponding to yellow (Y), magenta (M), cyan (C), and black (K) colors sequentially formed on the photoreceptors 12 are transferred onto a recording medium 24, which is transported through a transport belt 20 supported by support rollers 40 and 42, at positions at which the photoreceptors 12 oppose the corresponding transfer devices 22 across the transport belt 20. The recording medium 24 onto which the toner images have been transferred from the photoreceptors 12 is further transported to a fixing device 64. The toner images are heated and pressed by the fixing device 64 and thus fixed to the recording medium 24. In the case of single-sided printing, the recording medium 24 to which the toner images have been fixed is subsequently discharged onto a discharge section 68 in the upper part of the image forming apparatus 10 by discharge rollers 66.

The recording medium 24 is drawn out from a storage container 28 by a drawing roller 30 and transported to the transport belt 20 by transport rollers 32 and 34.

In the case of double-sided printing, the recording medium 24 having a first surface (front surface) to which the toner images have been fixed by the fixing device 64 is not discharged onto the discharge section 68 by the discharge rollers 66, and the discharge rollers 66 are reversely rotated while the trailing edge of the recording medium 24 is sandwiched between the discharge rollers 66. Accordingly, the recording medium 24 is introduced to a transport path 70 for double-sided printing, and the recording medium 24 is transported onto the transport belt 20 again by transport rollers 72, which are disposed on the transport path 70 for double-sided printing, while the recording medium 24 is reversed upside down. The toner images are then transferred to a second surface (back surface) of the recording medium 24 from the photoreceptors 12. Subsequently, the toner images on the second surface (back surface) of the recording medium 24 are fixed by the fixing device 64, and the recording medium 24 (transfer receptor) is discharged onto the discharge section 68.

The residual toner, paper powder, and the like on the surface of each photoreceptor 12 after completion of the step of transferring the toner images are removed by a cleaning blade 80 each time the photoreceptor 12 rotates. The cleaning blade 80 is disposed on the surface of the photoreceptor 12 and downstream of the position at which the photoreceptor 12 opposes the corresponding transfer device 22 in the rotation direction of the photoreceptor 12. This configuration allows the photoreceptor 12 to be ready for the subsequent image forming step.

The image forming apparatus 10 according to the exemplary embodiment is not limited to the foregoing structure and may be a well-known image forming apparatus, such as an image forming apparatus of the intermediate transfer system.

The image forming apparatus 212 illustrated in FIG. 2 is an example ink-jet image forming apparatus (hereinafter may be referred to as an ink-jet recording apparatus).

As illustrated in FIG. 2, the ink-jet recording apparatus 212 according to the exemplary embodiment includes, for example, a sheet feed container 216 in a lower part of a housing 214 and has a mechanism that allows sheets 200P (example recording media) stacked in the sheet feed container 216 to be drawn out one by one by a drawing roller 218. A drawn sheet 200A is transported by plural carrying-in roller pairs 220 which form a carrying-in path 222.

An endless transport belt 228 is disposed above the sheet feed container 216. The endless transport belt 228 is stretched and supported by a driving roller 224 and a driven roller 226. Recording heads 230 (example ejecting devices) are disposed above the transport belt 228 and oppose a flat part of the transport belt 228. A region where the recording heads 230 oppose a flat part of the transport belt 228 is an ejection region where ink droplets are ejected from the recording heads 230 onto the sheet 200P. The sheet 200P transported through the carrying-in roller pairs 220 reaches this ejection region while the sheet 200P is supported by the transport belt 228. The sheet 200P thus comes to oppose the recording heads 230, and ink droplets ejected from the recording heads 230 according to image information are attached to the surface of the sheet 200P.

The recording head 230 for each color is connected to the corresponding ink cartridge 230A for each color, which is attachable to and detachable from the ink-jet recording apparatus 212, through a supply pipe (not illustrated). The ink cartridge 230A supplies a color ink to the corresponding recording head 230.

Each recording head 230 is, for example, a long recording head of which an effective recording region (a region in which an ink ejecting nozzle is disposed) is longer than or equal to the width (the length of a sheet 200P in a direction intersecting (e.g., perpendicular to) the transport direction) of a sheet 200P.

Each recording head 230 is not limited to this and may be a recording head that is shorter than the width of a sheet 200P. This type (i.e., carriage type) of recording head moves in the with direction of a sheet 200P and ejects an ink.

Each recording head 230 may be a known recording head, such as a thermal recording head which thermally ejects ink droplets, or a piezoelectric recording head which ejects ink droplets by means of pressure.

The recording heads 230 are, for example, four recording heads corresponding to four colors, yellow (Y), magenta (M), cyan (C), and black (K), arrayed in the transport direction. It should be understood that the recording heads 230 are not limited to four recording heads 230 corresponding to four colors as described above and may include one recording head 230 corresponding to black (K) or may include five or more recording heads corresponding to five or more colors including other intermediate colors, depending on the purpose.

A charging roller 232 is disposed upstream (upstream in the transport direction of the sheet 200P) of the recording heads 230. The charging roller 232 is driven while the transport belt 228 and the sheet 200P are sandwiched between the charging roller 232 and the driven roller 226. A potential is thus generated between the charging roller 232 and the ground driven roller 226 so that the sheet 200P is charged and electrostatically adsorbed to the transport belt 228.

An ultraviolet radiation device 250 is disposed downstream (downstream in the transport direction of the sheet 200P) of the recording heads 230 and above the transport belt 228.

The ultraviolet radiation device 250 radiates ultraviolet rays toward the inks attached to the sheet 200P on the transport belt 228.

The ultraviolet radiation device 250 is, for example, a long ultraviolet radiation device of which an effective ultraviolet radiation region (a region in which an ultraviolet light source is disposed) is longer than or equal to the width (in a direction intersecting (e.g., perpendicular to) the transport direction of the sheet 200P) of a recordable region of the recording head 230.

The ultraviolet radiation device 250 is not limited to this and may be an ultraviolet radiation device that is shorter than the recordable region of the recording head 230. This type (i.e., carriage type) of ultraviolet radiation device moves in the with direction of the recordable region of the recording head 230 and radiates ultraviolet rays.

The light source of the ultraviolet radiation device 250 is a light source that radiates ultraviolet rays in a longer wavelength region (wavelength region from 375 nm to 450 nm) that is close to the visible light region in which the energy efficiency is high. Specific examples of the light source include a light emitting diode (LED), a semiconductor laser (LD, VCSEL), and a wavelength conversion laser light source.

Among these, the light source of the ultraviolet radiation device 250 may be an ultraviolet light emitting diode (UV-LED).

A releasing plate 234 is disposed downstream (downstream in the transport direction of a sheet 200P) of the ultraviolet radiation device 250 and releases the sheet 200P from the transport belt 228. The released sheet 200P is transported by plural discharge roller pairs 238, which form a discharge path 236 downstream (downstream in the transport direction of the sheet 200P) of the releasing plate 234, and discharged to a discharged sheet container 240 disposed in an upper part of the housing 214.

A cleaning roller 248 capable of holding the transport belt 228 together with the driving roller 224 is disposed below the releasing plate 234 and cleans the surface of the transport belt 228.

Next, the operation of the ink-jet recording apparatus 212 according to the exemplary embodiment will be described.

In the ink-jet recording apparatus 212 according to the exemplary embodiment, sheets 200P are drawn out one by one by the drawing roller 218 from the sheet feed container 216 and transported to the transport belt 228 through the carrying-in path 222.

Next, each sheet 200P is electrostatically adsorbed to the transport belt 228 by the charging roller 232, and transported downstream of the recording heads 230 as the transport belt 228 rotates.

Next, the recording heads 230 eject inks onto the sheet 200P, and a desired image is recorded on the sheet 200P accordingly.

Next, the inks attached to the sheet 200P are irradiated with ultraviolet rays from the ultraviolet radiation device 250, and the curing reaction (polymerization reaction) of an ultraviolet polymerizable compound in each of the inks proceeds so that the inks (ink images) are cured and fixed to the sheet 200P.

The ultraviolet radiation conditions of the ultraviolet radiation device 250 may be, for example, conditions under which the curing reaction (polymerization reaction) of the ultraviolet polymerizable compound in each of the inks ejected onto the sheet 200P proceeds so that the inks are cured, although the ultraviolet radiation conditions depend on, for example, the type of ultraviolet polymerizable compound contained in the ink.

Specifically, the ultraviolet radiation conditions may be such that the wavelength region (center wavelength) is from 375 nm to 450 nm, the irradiance is 10 $mW/cm^2$ or higher and 5000 $mW/cm^2$ or lower (preferably 50 $mW/cm^2$ or higher and 500 $mW/cm^2$ or lower), and the irradiation time is 0.1 ms or longer and 10 ms or shorter (preferably 10 ms or longer and 100 ms or shorter).

Next, the sheet 200 on which the inks (ink images) are fixed (formed) is discharged to the discharged sheet container 240 through the discharge path 236.

In the ink-jet recording apparatus 212 according to the exemplary embodiment, the sheet 200P on which the inks (ink images) are fixed (formed) is obtained accordingly.

In the description of the ink-jet recording apparatus 212 according to the exemplary embodiment, the recording heads 230 eject ink droplets directly onto the surface of the sheet 200P. However, the ink-jet recording apparatus is not limited to this type. For example, ink droplets may be ejected onto an intermediate transfer body, and the ink droplets on the intermediate transfer body may be then transferred to the sheet 200P.

In the description of the ink-jet recording apparatus 212 according to the exemplary embodiment, inks (ink images) are fixed (formed) on flat paper serving as a sheet 200P. However, inks (ink images) may be fixed (formed) on roll paper serving as a sheet 200P by using a continuous form printer.

The charging device 11 included in the image forming apparatus 10, which is an example electrophotographic image forming apparatus, will be described below.

Charging Device 11

Figure 5:
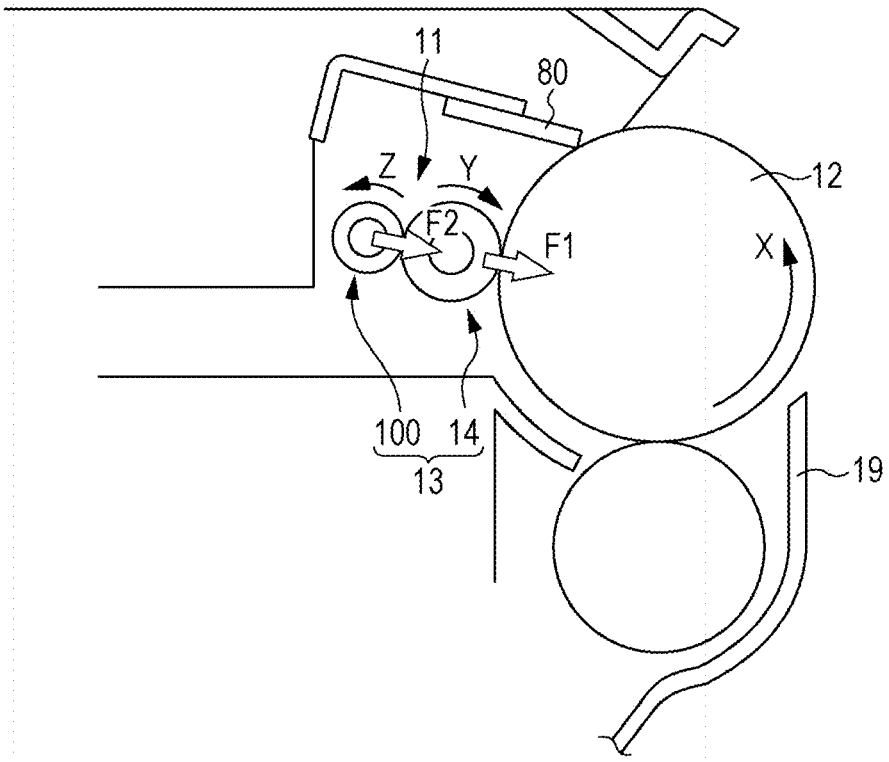
FIG. 5 is an enlarged schematic view of a charging member (charging device) and the surrounding area in FIG. 1 and FIG. 4.

As illustrated in FIG. 5, the charging device 11 (charging unit) includes a cleaning device 13. The cleaning device 13 includes the charging member 14 (an example charging body, an example body to be cleaned), which charges the photoreceptor 12, and a cleaning member 100, which cleans the charging member 14. The detailed structures of the charging member 14 and the cleaning member 100 will be described below.

Charging Member 14

Figure 6:
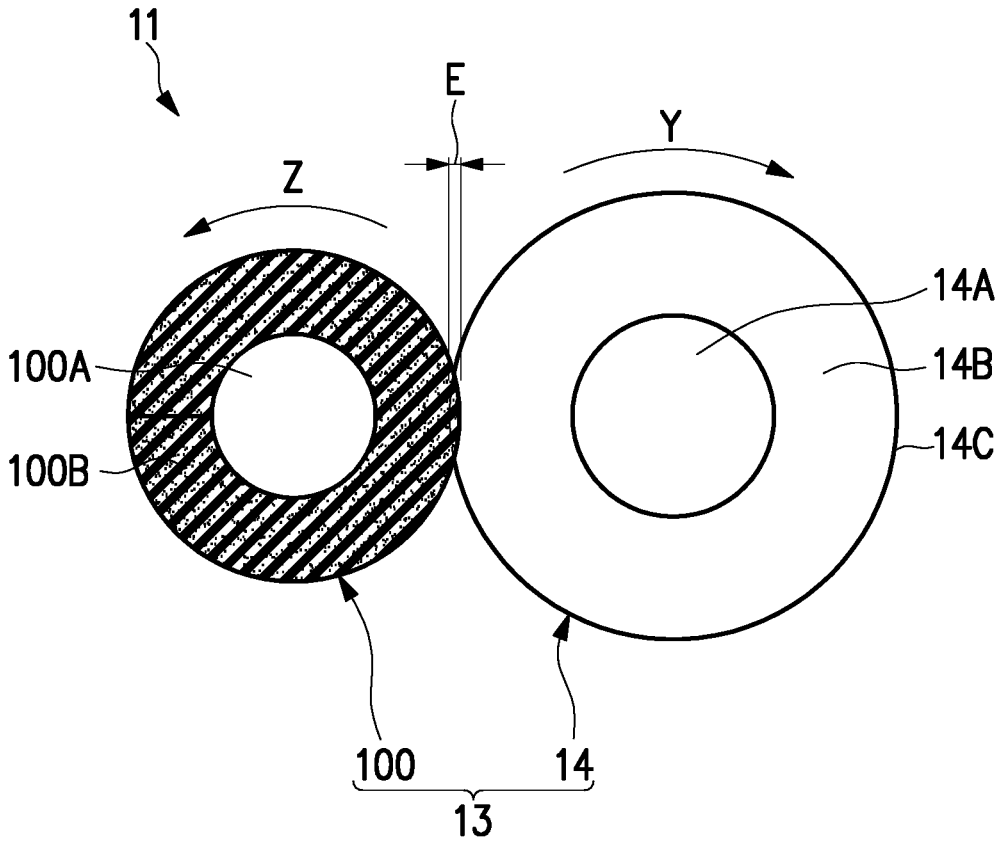
FIG. 6 is a schematic side view of an example charging device according to an exemplary embodiment.

The charging member 14 illustrated in FIG. 5 is an example body to be cleaned. The body to be cleaned has an uneven surface. The charging member 14 is also an example charging body that charges the body to be charged. Specifically, the charging member 14 is a charging roller that charges the photoreceptor 12. More specifically, the charging member 14 includes a support 14A and a conductive elastic layer 14B, as illustrated in FIG. 6.

Support 14A

The support 14A is, specifically, a conductive cylindrical or hollow cylindrical shaft. The support 14A is made of, for example, free-cutting steel or stainless steel. The surface treatment method and the like are appropriately selected according to the required functionality, such as sliding properties. When the support 14A is made of a non-conductive material, the support 14A may be rendered conductive by an ordinary electrical conduction treatment, such as a plating treatment.

Conductive Elastic Layer 14B

The conductive elastic layer 14B is, specifically, a conductive foamed elastic layer. The conductive elastic layer 14B is disposed on the outer circumference of the support 14A to form a hollow cylindrical shape.

The conductive elastic layer 14B may be made of a material obtained by adding, for example, to an elastic material having elasticity such as rubber, a conductive agent for adjusting the resistance, and as necessary, materials that may be added to ordinary rubber, such as a softener, a plasticizer, a hardener, a vulcanizing agent, a vulcanization accelerator, an anti-aging agent, and a filler such as silica or calcium carbonate.

The conductive agent for adjusting the resistance may be, for example, a material that conducts electricity through charge carriers, such as at least either electrons or ions. The conductive agent may be, for example, carbon black or an ion conductive agent to be added to a matrix material.

The elastic material of the conductive elastic layer 14B is formed by, for example, dispersing a conductive agent in a rubber material. Examples of the rubber material include a silicone rubber, an ethylene propylene rubber, an epichlorohydrin-ethylene oxide copolymer rubber, an epichlorohydrin-ethylene oxide-allyl glycidyl ether copolymer rubber, an acrylonitrile-butadiene copolymer rubber, and blended rubbers thereof. These rubber materials may be foamed or non-foamed.

Examples of the conductive agent include electroconductive agents and ion conductive agents. Examples of electroconductive agents include fine powders formed of carbon black, such as Ketjenblack and acetylene black; fine powders formed of pyrolytic carbon or graphite; fine powders formed of various conductive metals or alloys, such as aluminum, copper, nickel, and stainless steel; fine powders formed of various conductive metal oxides, such as tin oxide, indium oxide, titanium oxide, tin oxide-antimony oxide solid solution, and tin oxide-indium oxide solid solution; and fine powders formed of a material obtained by subjecting the surface of an insulating material to an electrical conductive treatment.

Examples of ion conductive agents include perchlorates and chlorates of oniums, such as tetraethylammonium and lauryltrimethylammonium; perchlorates and chlorates of alkali metals and alkaline earth metals, such as lithium and magnesium. These conductive agents may be used alone or in combination of two or more.

The amount of the conductive agent added is not limited. The amount of the electroconductive agent added may be in the range of 1 part by mass or more and 60 parts by mass or less relative to 100 parts by mass of the rubber material. The amount of the ion conductive agent added may be in the range of 0.1 parts by mass or more and 5.0 parts by mass or less relative to 100 parts by mass of the rubber material. When the resistance is controlled with such a conductive agent, the resistance of the conductive elastic layer 14B does not change depending on the environmental conditions, which may result in stable properties.

The charging member 14 may have a surface layer 14C on its surface. The material of the surface layer 14C is not limited, and the surface layer 14C may be made of any polymer material, such as resin (polymer material) or rubber.

Examples of the polymer material in the surface layer 14C include polyvinylidene fluoride, tetrafluoroethylene copolymers, polyester, polyimide, and copolymer nylon. Examples of the polymer material in the surface layer 14C include fluorocarbon-based resins and silicone-based resins. The polymer material may be used alone or in combination of two or more.

The resistance may be adjusted by adding a conductive material to the surface layer 14C. Examples of the conductive material for adjusting the resistance include carbon black, conductive metal oxide particles, and an ion conductive agent. The conductive material may be used alone or in combination of two or more.

The surface layer 14C may contain insulating particles made of, for example, alumina or silica.

Configuration for Supporting Charging Member 14

In the charging member 14 illustrated in FIG. 5, the opposite ends of the support 14A in the axial direction are rotatably supported by support parts (not illustrated), such as bearings. The charging member 14 is pressed against the photoreceptor 12 by applying a load F1 to the opposite ends of the support 14A in the axial direction via the support parts. Accordingly, the conductive elastic layer 14B elastically deforms along the surface (outer circumferential surface) of the photoreceptor 12 to form a contact region having a specific width between the charging member 14 and the photoreceptor 12.

As the photoreceptor 12 is driven to rotate in the direction of arrow X by means of a motor (not illustrated), the charging member 14 rotates in the direction of arrow Y by following the rotation of the photoreceptor 12. In other words, the charging member 14 is driven to rotate such that the axial direction of the support 14A corresponds to the direction of the rotation axis. Therefore, the axial direction of the charging member 14 and the axial direction of the support 14A correspond to the direction of the rotation axis of the charging member 14. It is noted that the cleaning member 100 is driven to rotate in the direction of arrow Z as the charging member 14 rotates.

Cleaning Member 100

Figure 7:
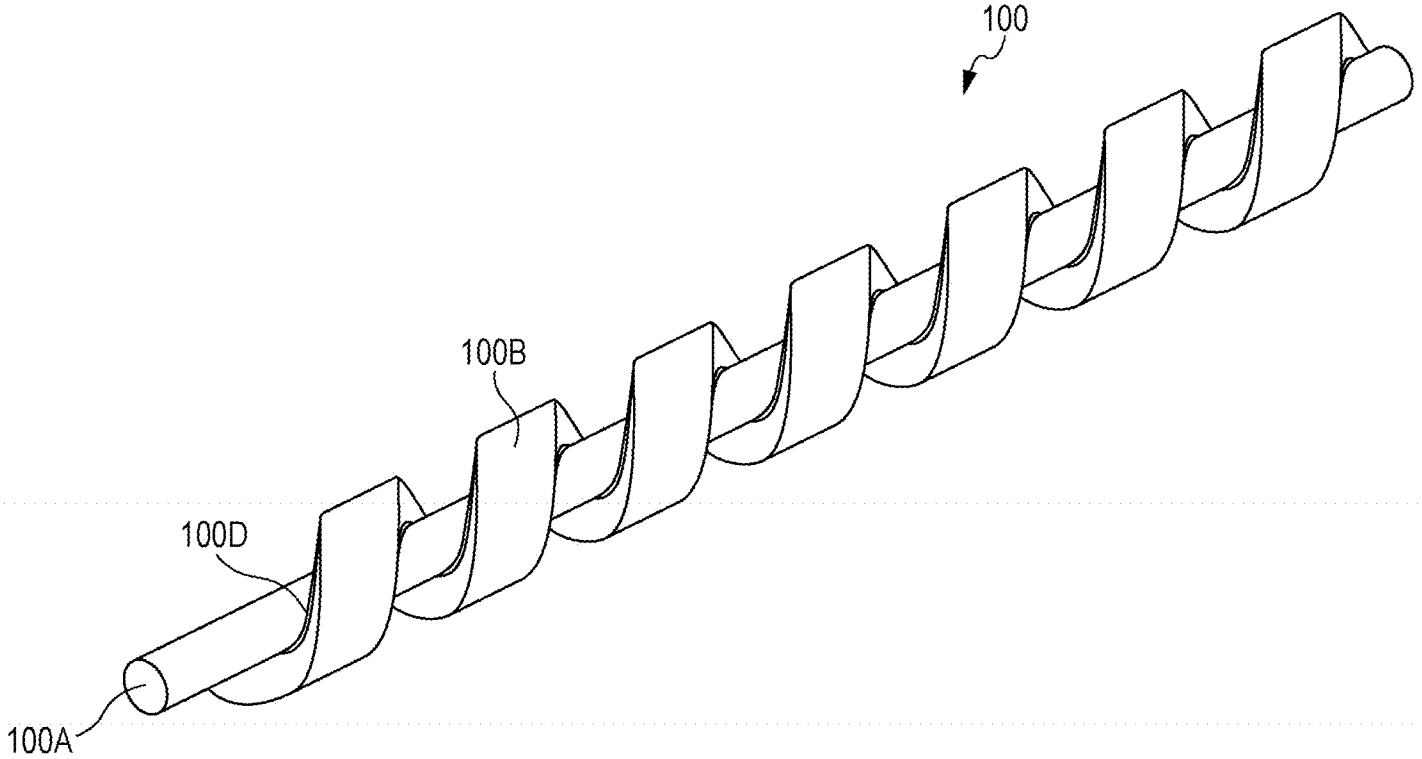
FIG. 7 is a schematic perspective view of an example cleaning member according to an exemplary embodiment.
Figure 8:
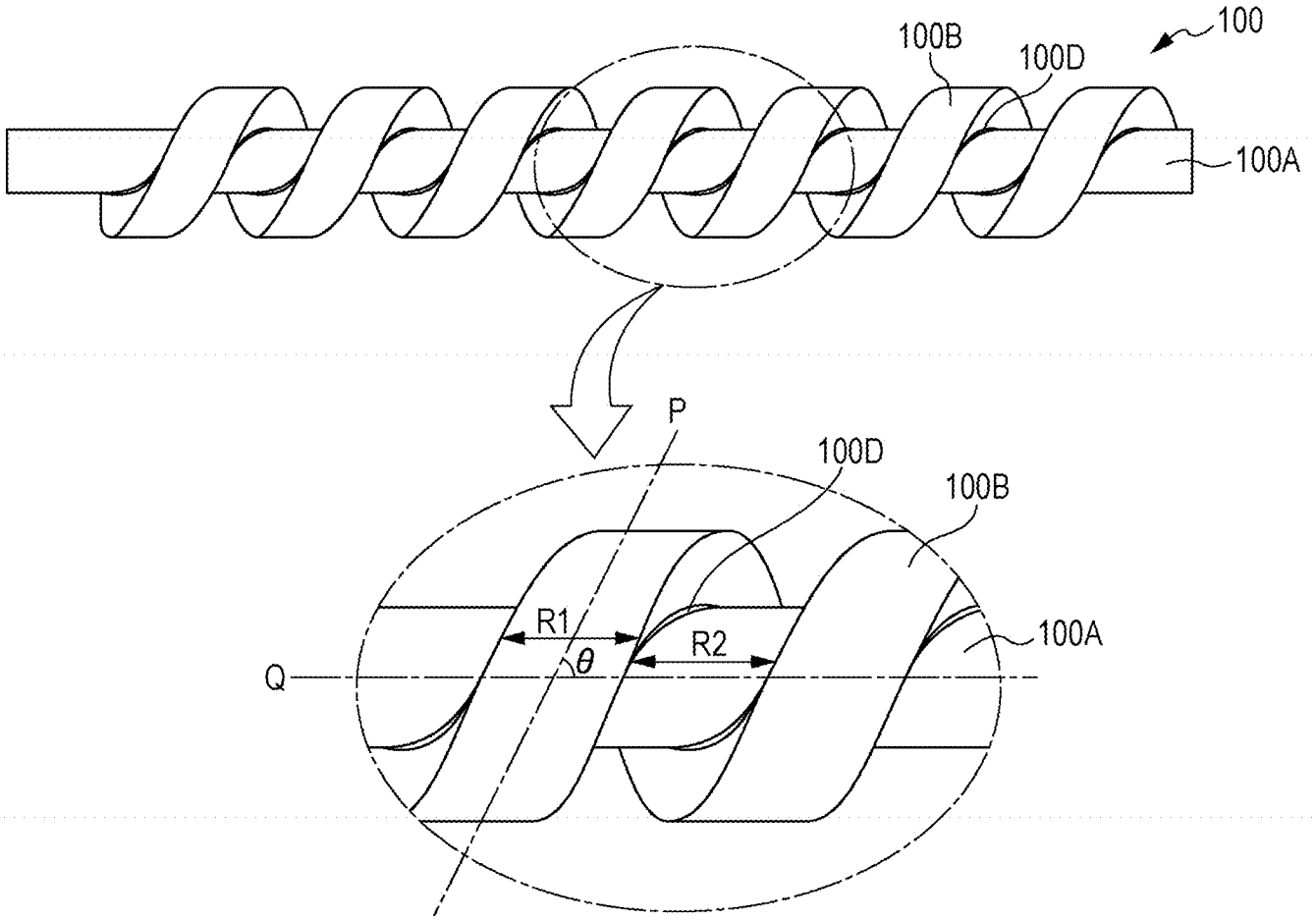
FIG. 8 is a schematic plan view of the example cleaning member according to the exemplary embodiment.

FIG. 7 is a schematic perspective view of a cleaning member (example cleaning body) according to an exemplary embodiment. FIG. 8 is a schematic plan view of the cleaning member (example cleaning body) according to the exemplary embodiment.

The cleaning member 100 (example cleaning body) illustrated in FIG. 7 and FIG. 8 includes a core 100A (an example shaft) and a foamed elastic layer 100B (example elastic layer), which is disposed on the outer circumferential surface of the core 100A and comes into contact with the charging member 14.

The cleaning member 100 includes an adhesive layer 100D in addition to the core 100A and the foamed elastic layer 100B. The adhesive layer 100D bonds the core 100A and the foamed elastic layer 100B. The cleaning member 100 is a roll-shaped member.

Core 100A

Examples of the material used for the core 100A include metals (e.g., free-cutting steel or stainless steel) and resins (e.g., polyacetal resin (POM)). The material, the surface treatment method, and the like may be selected as necessary.

In particular, when the core 100A is made of metal, the core 100A may undergo a plating treatment. When the core 100A is made of a non-conductive material, such as resin, the core 100A may be rendered conductive by an ordinary treatment such as a plating treatment or may be used without any treatment.

Adhesive Layer 100D

The adhesive layer 100D may be made of any material that may bond the core 100A and the foamed elastic layer 100B. The adhesive layer 100D may be formed of, for example, a double-sided tape or other adhesive.

Foamed Elastic Layer 100B

The foamed elastic layer 100B is made of a foamed material (i.e., foam). Specific materials of the foamed elastic layer 100B will be described below.

Figure 10:
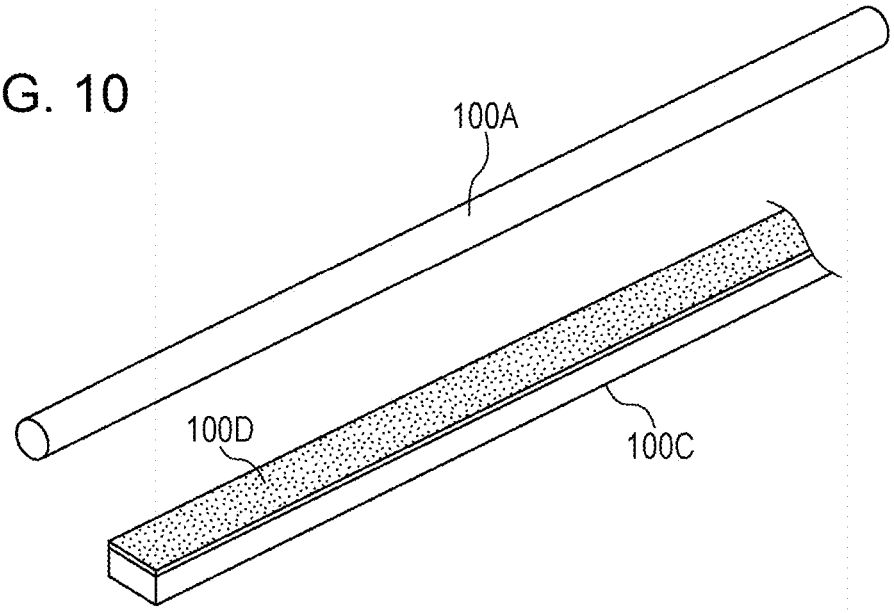
FIG. 10 is a process view illustrating a step of an example method for producing a cleaning member according to an exemplary embodiment.
Figure 11:
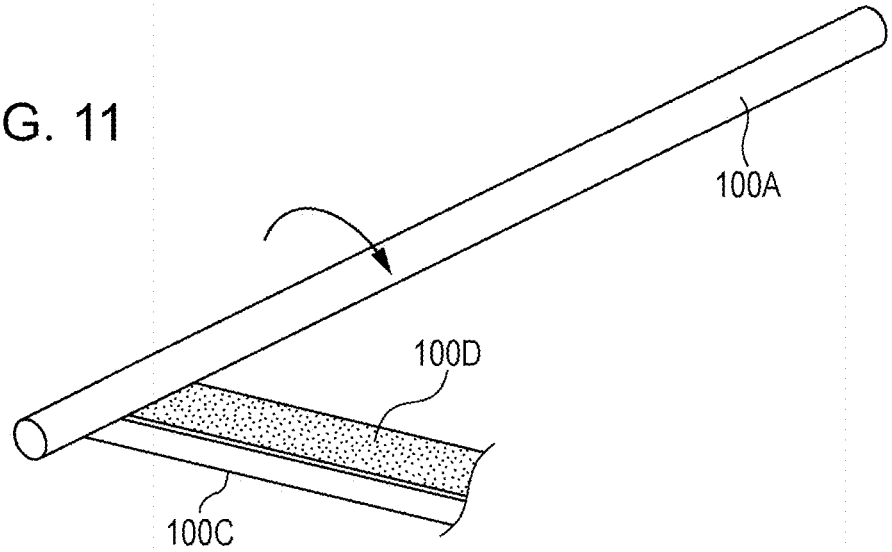
FIG. 11 is a process view illustrating a step of the example method for producing the cleaning member according to the exemplary embodiment.
Figure 12:
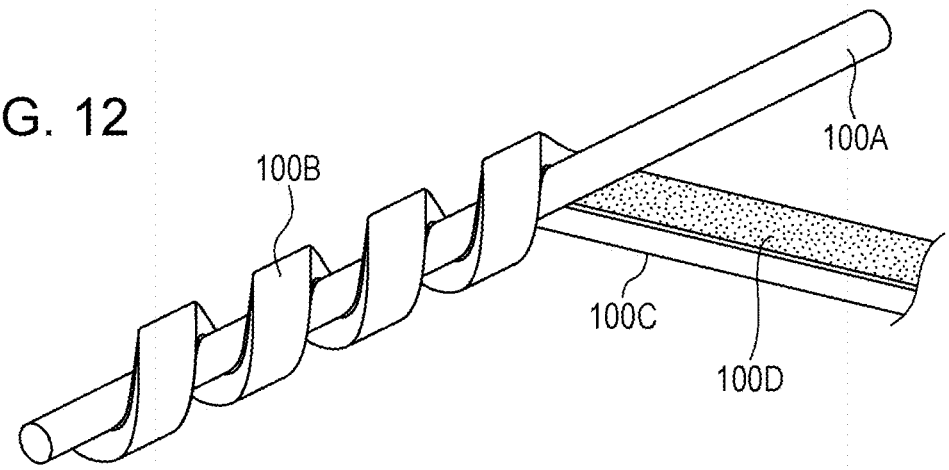
FIG. 12 is a process view illustrating a step of the example method for producing the cleaning member according to the exemplary embodiment.

As illustrated in FIG. 7 and FIG. 8, the foamed elastic layer 100B is spirally disposed on the outer circumferential surface of the core 100A from one end side of the core 100A in the axial direction to the other end side in the axial direction of the core 100A. Specifically, as illustrated in FIG. 10 to FIG. 12, the foamed elastic layer 100B is formed by, for example, spirally winding a strip-shaped foamed elastic member 100C (hereinafter may be referred to as a strip 100C) at a predetermined spiral pitch around the core 100A, which serves as a spiral axis, from one end of the core 100A in the axial direction to the other end in the axial direction of the core 100A.

Figure 9:
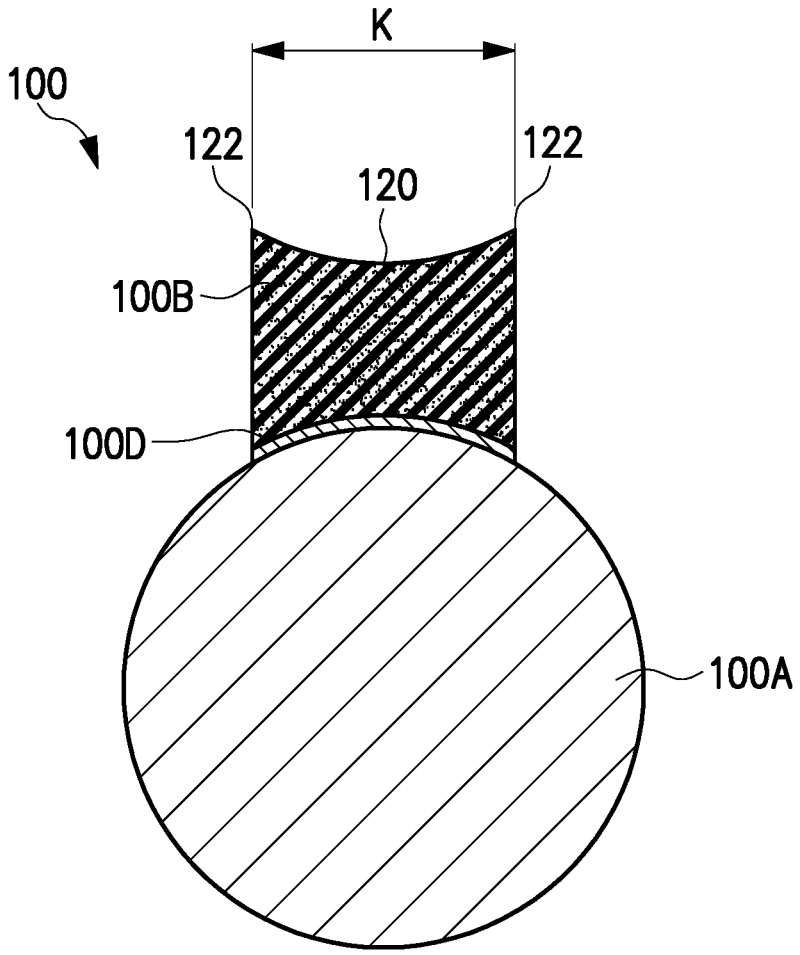
FIG. 9 is a schematic sectional view of the example cleaning member according to the exemplary embodiment as viewed in the axial direction.

FIG. 9 is a schematic sectional view of the cleaning member (example cleaning body) according to the exemplary embodiment as viewed in the axial direction. As illustrated in FIG. 9, the foamed elastic layer 100B has a quadrangular shape defined by four sides (including curves) in the cross-section as viewed in the axial direction of the core 100A. The opposite edges of the foamed elastic layer 100B in the width direction (K direction) have projections 122 that project outward beyond a central portion 120 in the radial direction of the core 100A. The projections 122 are formed in the longitudinal direction of the foamed elastic layer 100B.

The projections 122 are formed by, for example, applying tension to the foamed elastic layer 100B in the longitudinal direction to generate a difference in outer diameter between the central portion 120 of the outer circumferential surface of the foamed elastic layer 100B in the width direction and the opposite edges of the foamed elastic layer 100B in the width direction.

In the exemplary embodiment, each projection 122 extends 10% of the distance from one edge to the other edge in the K direction as measured along the surface of the elastic layer curved in a concave shape. The central portion 120 resides in the region except for the regions of the projections 122 at the opposite edges in the K direction.

The foamed elastic layer 100B is disposed spirally. In the foamed elastic layer 100B, an end portion of a cell skeleton protruding from the surface of the foamed elastic layer has an equivalent circle diameter of 50 μm or less, a spiral pitch R2 of 5 mm or less, and a spiral angle θ of 15° or less.

The equivalent circle diameter of an end portion of the cell skeleton protruding from the surface of the foamed elastic layer is measured by using a confocal microscope (Lasertec Corporation, OPTELICS HYBRID). The observed image (see FIG. 3) of the end surface of an end portion C of the cell skeleton protruding from the surface of the foamed elastic layer is captured at three points, and the equivalent circle diameter on the end surface of the end portion C is calculated by image analysis. The average value is defined as the equivalent circle diameter of the end portion of the cell skeleton protruding from the surface of the foamed elastic layer.

Figure 3:
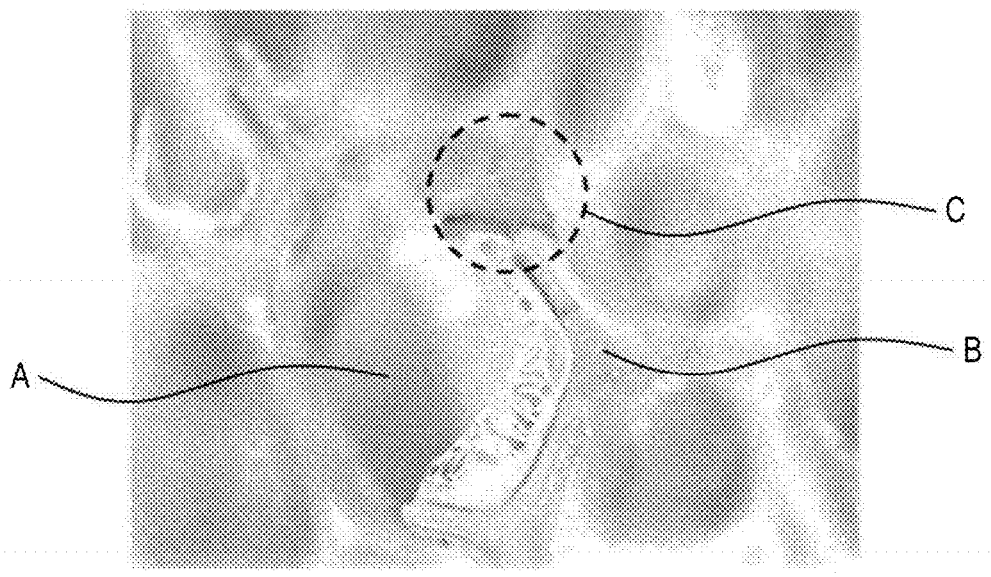
FIG. 3 is a photograph of the surface of a foamed elastic layer according to an exemplary embodiment.

The reference character A in FIG. 3 represents a cell protruding from the surface of the foamed elastic layer.

The reference character B in FIG. 3 represents a cell skeleton protruding from the surface of the foamed elastic layer.

The reference character C in FIG. 3 represents an end portion of the cell skeleton protruding from the surface of the foamed elastic layer.

The equivalent circle diameter of an end portion of a cell skeleton protruding from the surface of the foamed elastic layer corresponds to the equivalent circle diameter of the end portion C of the cell skeleton protruding from the surface of the foamed elastic layer.

The cell skeleton refers to a line-shaped or film-shaped structure that forms cells (i.e., foam). The end portion of a cell skeleton protruding from the surface of the foamed elastic layer corresponds to a protruding portion of the structure on the surface of the foamed elastic layer.

The equivalent circle diameter of an end portion of a cell skeleton protruding from the surface of the foamed elastic layer is preferably 30 μm or more and 50 μm or less, and more preferably 35 μm or more and 45 μm or less in order to improve the cleaning performance of the cleaning body.

The spiral pitch R2 refers to the distance between adjacent portions of the foamed elastic layer 100B in the axial direction Q (core axial direction) of the cleaning member 100 having the foamed elastic layer 100B (see FIG. 8).

The spiral pitch R2 of the foamed elastic layer 100B is preferably 2 mm or more and 5 mm or less, and more preferably 3 mm or more and 4 mm or less in order to improve the cleaning maintainability of the cleaning body.

The spiral angle θ refers to an angle (acute angle) at which the longitudinal direction P (spiral direction) of the foamed elastic layer 100B intersects the axial direction Q (core axial direction) of the core 100A (see FIG. 8).

The spiral angle θ of the foamed elastic layer 100B is preferably 5° or more and 15° or less, and more preferably 8° or more and 10° or less in order to improve the cleaning maintainability of the cleaning body.

The spiral pitch R2 and the spiral angle θ of the foamed elastic layer satisfy the relationship of $0.2 \leq R2/\theta \leq 1.0$.

When the spiral pitch R2 and the spiral angle θ of the foamed elastic layer satisfy the foregoing relationship, the spiral structure of the foamed elastic layer is unlikely to change, which may improve the cleaning maintainability of the cleaning body.

The spiral pitch R2 and the spiral angle θ of the foamed elastic layer may satisfy the relationship of $0.4 \leq R2/\theta \leq 0.8$.

The spiral width R1 refers to the dimension of the foamed elastic layer 100B in the axial direction Q (core axial direction) of the cleaning member 100 (see FIG. 8). The spiral width R1 of the foamed elastic layer 100B may be, for example, 3 mm or more and 25 mm or less (preferably 3 mm or more and 10 mm or less).

The thickness of the foamed elastic layer 100B (the thickness of a central portion in the width direction) may be 1.0 mm or more and 3.0 mm or less, preferably 1.4 mm or more and 2.6 mm or less, and more preferably 1.6 mm or more and 2.4 mm or less in order to improve the cleaning maintainability of the cleaning body.

The thickness of the foamed elastic layer 100B is measured, for example, in the following manner.

With the circumferential direction of the cleaning member fixed, the profile of the thickness of the foamed elastic layer (the layer thickness of the foamed elastic layer) is measured by scanning the cleaning member in the longitudinal direction (axial direction) with a laser measuring device (laser scan micrometer available from Mitutoyo Corporation) at a traverse speed of 1 mm/s. The same measurement is then performed at different points in the circumferential direction (at three points 120° apart in the circumferential direction). The thickness of the foamed elastic layer 100B is calculated on the basis of this profile.

The coverage of the foamed elastic layer 100B (the spiral width R1 of the foamed elastic layer 100B/[the spiral width R1 of the foamed elastic layer 100B+the spiral pitch R2 of the foamed elastic layer 100B: (R1+R2)]) may be 20% or more and 70% or less, and preferably 25% or more and 55% or less.

When the coverage is larger than the foregoing range, the time during which the foamed elastic layer 100B is in contact with the body to be cleaned is long and, therefore, adhesive substances on the surface of the cleaning member tend to recontaminate the body to be cleaned. When the coverage is smaller than the foregoing range, it is difficult to stabilize the thickness (layer thickness) of the foamed elastic layer 100B, and the cleaning ability tends to deteriorate.

The number of cells in the foamed elastic layer of the cleaning body according to the exemplary embodiment is preferably 80 cells/25 mm or more and 105 cells/25 mm or less, more preferably 85 cells/25 mm or more and 100 cells/25 mm or less, and more preferably 90 cells/25 mm or more and 95 cells/25 mm or less in order to improve the cleaning maintainability of the cleaning body.

The number of cells in the foamed elastic layer 100B is determined in accordance with JIS K 6400-1:2004 (Annex 1).

The foamed elastic layer 100B refers to a layer made of a material that deforms under an external force of 100 Pa and restores to its original shape.

Material of Foamed Elastic Layer 100B

Examples of the material of the foamed elastic layer 100B include materials obtained by blending one or two or more materials selected from foamed resins (e.g., polyurethanes, polyethylenes, polyamides, and polypropylenes) and rubber materials (e.g., silicone rubber, fluorocarbon rubber, urethane rubber, ethylene-propylene-diene rubber (EPDM), acrylonitrile-butadiene copolymer rubber (NBR), chloroprene rubber (CR), chlorinated polyisoprene, isoprene, acrylonitrile-butadiene rubber, styrene-butadiene rubber, hydrogenated polybutadiene, and butyl rubber).

Such a material may be mixed with an auxiliary, such as a foaming auxiliary, a foam stabilizer, a catalyst, a curing agent, a plasticizer, or a vulcanization accelerator, as necessary.

The foamed elastic layer 100B may be made of foamed polyurethane having high tensile strength in order not to scratch, particularly by friction, the surface of the body to be cleaned (charging member 14) or in order to prevent the foamed elastic layer 100B from being torn or damaged for a long period of time.

Examples of polyurethane include reaction products between polyols (e.g., polyester polyols, polyether polyols, polyesters, and acrylic polyols) and isocyanates (e.g., 2,4-tolylene diisocyanate, 2,6-tolylene diisocyanate, 4,4-diphenylmethane diisocyanate, tolylene diisocyanate, and 1,6-hexamethylene diisocyanate). Polyurethane may include a chain extender (1,4-butanediol or trimethylolpropane).

Polyurethane is typically foamed by using a foaming agent, such as water or an azo compound (e.g., azodicarbonamide or azobisisobutyronitrile).

The foamed polyurethane may be mixed with an auxiliary, such as a foaming auxiliary, a foam stabilizer, or a catalyst, as necessary.

Configuration for Supporting Cleaning Member 100

As illustrated in FIG. 5, the foamed elastic layer 100B of the cleaning member 100 is in contact with the surface of the charging member 14 opposite to the photoreceptor 12. Specifically, the foamed elastic layer 100B of the cleaning member 100 is pressed against the charging member 14 by pressing the opposite ends of the core 100A in the axial direction toward the charging member 14 under a load F2. As a result, the foamed elastic layer 100B elastically deforms along the circumferential surface of the charging member 14 to form a contact region.

The compression ratio of the foamed elastic layer 100B is calculated from [(the thickness of the original foamed elastic layer 100B−the thickness of the foamed elastic layer 100B in the region in contact with the charging member 14 (i.e., the body to be cleaned)/the thickness of the original foamed elastic layer 100B]×100.

The thickness of the foamed elastic layer 100B refers to the thickness of a central portion of the foamed elastic layer 100B in the width direction with the foamed elastic layer 100B disposed on the core 100A.

The amount of nipping between the charging member 14 and the cleaning member 100 (see FIG. 6) is obtained from a difference between the center distance between the charging member 14 and the cleaning member 100 and a value obtained by adding the radius of the cleaning member 100 in an unloaded state to the radius of the charging member 14 in an unloaded state. If the amount of nipping varies in the axial direction of the cleaning member 100, the minimum amount of nipping is taken as the amount of nipping.

The cleaning member 100 is driven to rotate in the direction of arrow Z as the charging member 14 rotates. The cleaning member 100 is not necessarily in contact with the charging member 14 all the time. The cleaning member 100 may be driven to rotate by contact with the charging member 14 only during cleaning of the charging member 14. Alternatively, the cleaning member 100 may be brought into contact with the charging member 14 only during cleaning of the charging member and rotated by separately driving the cleaning member 100 and the charging member 14 with a circumferential speed difference.

The foamed elastic layer 100B of the cleaning member 100 in contact with the charging member 14 may exhibit a displacement ratio of 15% or less.

The displacement ratio refers to the percentage of change in the thickness of the foamed elastic layer 100B in the central portion 120 between before and after the cleaning member 100 is brought into contact with the charging member 14.

Specifically, the displacement ratio is calculated from [(the thickness of the foamed elastic layer 100B in the central portion 120 before the cleaning member 100 is brought into contact with the charging member 14—the thickness of the foamed elastic layer 100B in the central portion 120 after the cleaning member 100 is brought into contact with the charging member 14)/(the thickness of the foamed elastic layer 100B in the central portion 120 before the cleaning member 100 is brought into contact with the charging member 14)×100.

The displacement ratio of the foamed elastic layer 100B of the cleaning member 100 may be 12% or less in order to improve the cleaning maintainability of the cleaning body.

Method for Producing Cleaning Member 100

Next, a method for producing the cleaning member 100 according to an exemplary embodiment will be described. FIGS. 10 to 12 are process views illustrating an example method for producing the cleaning member 100 according to an exemplary embodiment.

First, as illustrated in FIG. 10, a sheet-shaped foamed elastic member (e.g., foamed polyurethane sheet) that has been sliced so as to have a desired thickness is prepared. The foamed elastic member is then punched with a punch die to provide a sheet having a desired width and a desired length.

A double-sided tape 100D is then stuck to one surface of the sheet-shaped foamed elastic member to provide a strip 100C (a strip-shaped foamed elastic member with the double-sided tape 100D) having a desired width and a desired length.

Next, as illustrated in FIG. 11, the strip 100C is disposed with the surface with the double-sided tape 100D upward. In this state, an end portion of the release liner of the double-sided tape 100D is released, and an end portion of the core 100A is placed on the portion of the double-sided tape from which the release liner has been released.

Next, as illustrated in FIG. 12, the strip 100C is spirally wound around the outer circumferential surface of the core 100A by rotating the core 100A at a desired speed while the release liner of the double-sided tape is being released. This provides the cleaning member 100 having the foamed elastic layer 100B spirally disposed around the outer circumferential surface of the core 100A.

When the strip 100C, which serves as the foamed elastic layer 100B, is wound around the core 100A, the strip 100C may be positioned such that the longitudinal direction of the strip 100C and the axial direction of the core 100A form a desired angle (spiral angle). The outer diameter of the core 100A may be, for example, Ø 3 mm or more and Ø 6 mm or less.

The tension applied when the strip 100C is wound around the core 100A may be such that no gap is generated between the core 100A and the double-sided tape 100D of the strip 100C, and excessive tension may not be applied. This is because the application of excessive tension tends to result in large tensile permanent elongation and tends to reduce the elastic force of the foamed elastic layer 100B required for cleaning. Specifically, for example, the tension may be such that the strip 100C elongates by more than 0% and 5% or less of its original length.

When the strip 100C is wound around the core 100A, the strip 100C tends to elongate. This elongation tends to vary in the thickness direction of the strip 100C, and the outer periphery of the strip 100C tends to elongate the most, which may reduce its elastic force. Therefore, the elongation of the outer periphery after the strip 100C is wound around the core 100A may be about 5% of the outer periphery of the original strip 100C.

This elongation is controlled by the radius of curvature at which the strip 100C is wound around the core 100A and the thickness of the strip 100C. The radius of curvature at which the strip 100C is wound around the core 100A is controlled by the outer diameter of the core 100A and the winding angle (spiral angle θ) of the strip 1000.

The radius of curvature at which the strip 100C is wound around the core 100A may be, for example, ((core outer diameter/2)+0.2 mm) or more and ((core outer diameter/2)+8.5 mm) or less, and preferably ((core outer diameter/2)+0.5 mm) or more and ((core outer diameter/2)+7.0 mm) or less.

The thickness of the strip 100C is, for example, 1.5 mm or more and 4 mm or less, and preferably 1.5 mm or more and 3.0 mm or less. The width of the strip 100C may be adjusted such that the coverage of the foamed elastic layer 100B is in the foregoing range. The length of the strip 100C is determined by, for example, the axial length of a region of the core 100A around which the strip 100C is to be wound, the winding angle (spiral angle θ), and the winding tension.

Operation of Exemplary Embodiments

Next, the operation of the exemplary embodiments will be described.

In the exemplary embodiments, foreign matter such as a developer that remains on the photoreceptor 12 without being transferred to the recording medium 24 is removed from the photoreceptor 12 by the cleaning blade 80. Part of foreign matter such as a developer that passes through under the cleaning blade 80 without being removed by the cleaning blade 80 adheres to the surface of the charging member 14 (see FIG. 1).

The foreign matter adhering to the surface of the charging member 14 is removed in such a manner that the projections 122 and the outer circumferential surface (upper surface in FIG. 9) come into contact with the charging member 14 and wipe the outer circumferential surface of the charging member 14.

Modification

Figure 13:
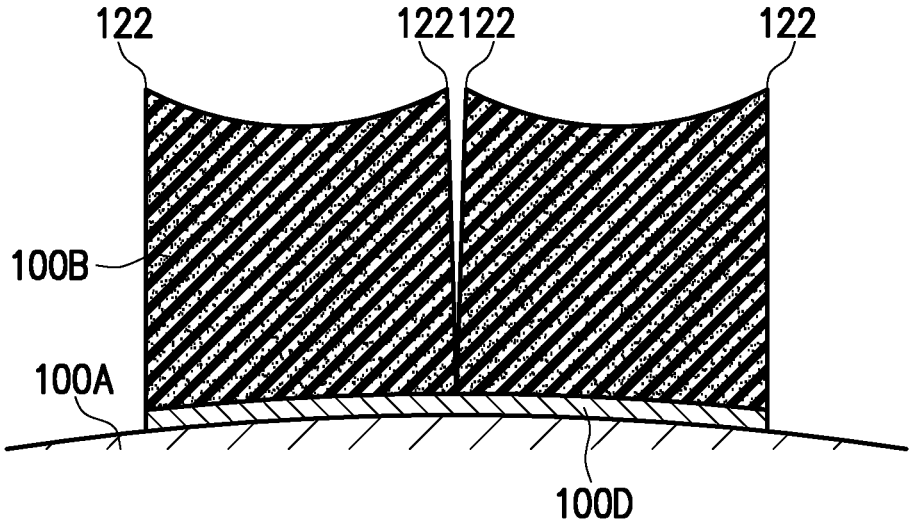
FIG. 13 is an enlarged sectional view of a foamed elastic layer in a cleaning member according to another exemplary embodiment.

The foamed elastic layer 100B is not necessarily formed of one strip 100C. For example, as illustrated in FIG. 13 and FIG. 14, the foamed elastic layer 100B may be formed of at least two or more strips 100C (strip-shaped foamed elastic members), and these two or more strips 100C may be spirally wound around the core 100A.

Figure 14:
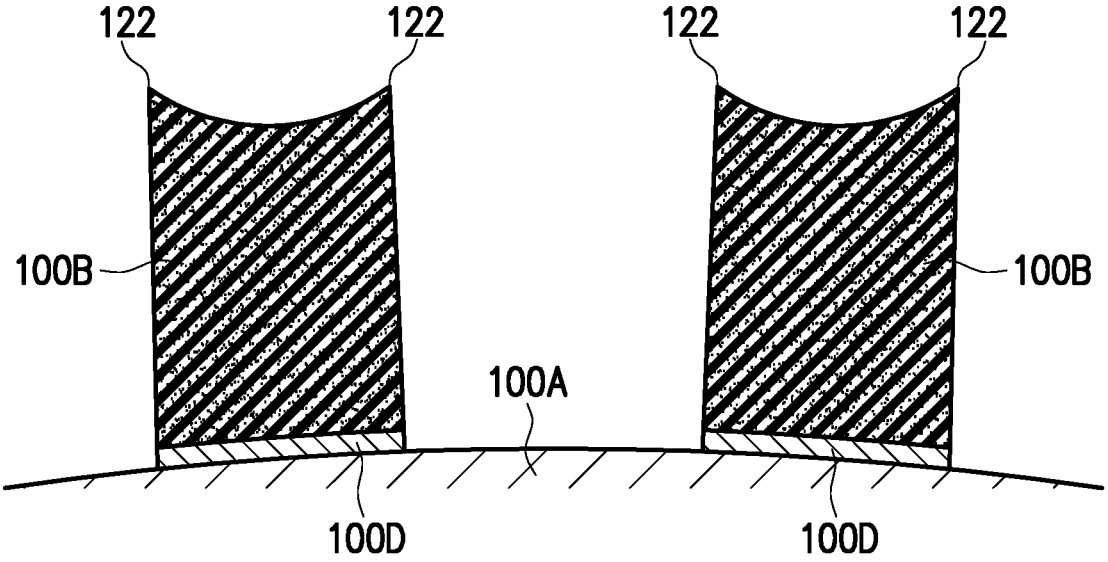
FIG. 14 is an enlarged sectional view of a foamed elastic layer in a cleaning member according to another exemplary embodiment.

In the foamed elastic layer 100B including two or more strips 100C (strip-shaped foamed elastic members) spirally wound around the core 100A, two or more strips 100C may be spirally wound such that the sides of the adhesive surfaces of the strips 100C (the surfaces of the strips 100C that oppose the outer circumferential surface of the core 100A) in the longitudinal direction are in contact with each other (see FIG. 13), or two or more strips 100C may be spirally wound in such a manner that the sides of the adhesive surfaces of the strips 100C in the longitudinal direction are out of contact with each other (see FIG. 14).

Other Modification

In the foregoing description, the image forming apparatus 10 according to the exemplary embodiment includes, as the charging device 11, a unit including the charging member 14 and the cleaning member 100, that is, includes the charging member 14 as a body to be cleaned. However, the image forming apparatus 10 according to the exemplary embodiment is not limited to this structure. Examples of the body to be cleaned include a photoreceptor (image carrier), a transfer device (transfer member; transfer roller), and an intermediate transfer body (intermediate transfer belt). The unit including the body to be cleaned and the cleaning member in contact with the body to be cleaned may be disposed directly in the image forming apparatus or may be disposed in the image forming apparatus as a cartridge like a process cartridge in the same manner as that described above.

The present disclosure is not limited to the foregoing exemplary embodiments, and various changes, modifications, and improvements can be made without departing from the spirit of the present disclosure. For example, the modifications described above can be combined as desired.

The present disclosure can be applied to an ink-jet recording apparatus which is an image forming apparatus other than those of the electrophotographic system. For example, the cleaning body according to the exemplary embodiment may be used as the cleaning roller 248 included in the image forming apparatus 212 illustrated in FIG. 2, which is an example ink-jet recording apparatus. For example, the cleaning body according to the exemplary embodiment may be used to clean an ink ejection outlet of an ink-jet recording head by contact with the ink-jet recording head at specific timing or may be used to clean the front surface and back surface of the sheet transport belt for ink-jet recording.

EXAMPLES

Examples will be described below, but the present disclosure is not limited to these Examples. In the following description, the units "part" and "W" are on a mass basis, unless otherwise specified.

Preparation of Charging Roller

Formation of Elastic Layer

The following mixture is kneaded with an open roller. The kneaded mixture is disposed around the outer circumferential surface of a conductive support so as to have a hollow cylindrical shape and a thickness of 1.5 mm. The conductive support is made of SUS416 and has a diameter of 9 mm and a length of 370 mm. The obtained product is placed in a hollow cylindrical mold having an inner diameter of 12.0 mm and vulcanized at 170° C. for 30 minutes. The volcanized material is taken out of the mold and then polished. This process provides a hollow cylindrical conductive elastic layer.

- Rubber material (epichlorohydrin-ethylene oxide-allyl glycidyl ether copolymer rubber, Gechron 3106 available from Zeon Corporation) . . . 100 parts by mass
- Conductive agent (carbon black, Asahi Thermal available from Asahi Carbon Co., Ltd.) . . . 25 parts by mass
- Conductive agent (Ketjenblack EC available from LION Corporation) . . . 8 parts by mass
- Ion conductive agent (lithium perchlorate) . . . 1 part by mass
- Vulcanizing agent (sulfur, 200 mesh available from Tsurumi Chemical Industry Co., Ltd.) . . . 1 part by mass
- Vulcanization accelerator (Nocceler DM available from Ouchi Shinko Chemical Industrial Co., Ltd.) . . . 2.0 parts by mass
- Vulcanization accelerator (Nocceler TT available from Ouchi Shinko Chemical Industrial Co., Ltd.) . . . 0.5 parts by mass Formation of Surface Layer The following mixture is mixed in a bead mill to form a dispersion. The obtained dispersion is diluted with methanol. The diluted dispersion is applied to the surface (outer circumferential surface) of the conductive elastic layer by dip coating and then dried by heating at 140° C. for 15 minutes. This process provides a charging roller 1 having a surface layer with a thickness of 4 μm.

Polymer material (copolymer nylon, Amilan CM8000 available from Toray Industries, Inc.) . . . 20 parts by mass Conductive agent (antimony-doped tin oxide, SN-100P available from Ishihara Sangyo Kaisha, Ltd.) . . . 30 parts by mass Solvent (methanol) . . . 500 parts by mass Solvent (butanol) . . . 240 parts by mass Example 1

Cleaning Roller 1

Four strips having a width of 4 mm and a length of 360 mm are prepared by cutting a urethane foam sheet having a thickness of 2.4 mm (FHS available from Inoac Corporation) out into strips having a width of 4 mm and a length of 360 mm. A double-sided tape having a thickness of 0.05 mm (No. 5605 available from Nitto Denko Corporation) is stuck to the entire surface of each of the four cut-out strips to provide strips each having the double-sided tape.

The obtained four strips each having the double-sided tape are bundled and placed on a horizontal stage in such a manner that the release liner attached to the double-sided tape faces downward. An end portion of each strip in the longitudinal direction is pressed from above by using heated stainless steel in such a manner that the thickness of a section of each strip in the range of 1 mm long in the longitudinal direction from the end portion of the strip in the longitudinal direction is 15% of the thickness of the other section.

The obtained four strips each having the double-sided tape are placed on a horizontal stage in such a manner that the release liner attached to the double-sided tape faces upward. The strips each having the double-sided tape are wound around a metal core (material=SUM24EZ, outer diameter=Ø 5.0 mm, full length=360 mm) with tension in such a manner that the full length of the strips elongates by 0% to 5% and that the spiral pitch R2 is 4 mm and the spiral angle θ is 10 with the sides of the adhesive surfaces of the strips in the longitudinal direction in contact with each other. The cleaning roller 1 is produced accordingly.

Example 2

Cleaning Roller 2

A cleaning roller 2 is produced in the same manner as in Example 1 except that the spiral angle θ at which the strips each having the double-sided tape are wound around the core is 15°.

Example 3

Cleaning Roller 3

A cleaning roller 3 is produced in the same manner as in Example 1 except that the spiral angle θ at which the strips each having the double-sided tape are wound around the core is 5°.

Example 4

Cleaning Roller 4

A cleaning roller 4 is produced in the same manner as in Example 1 except that two strips are prepared from a urethane foam sheet having a thickness of 2.4 mm, and the prepared two strips each having the double-sided tape are wound around the core in such a manner that the spiral pitch R2 is 5 mm with the sides of the adhesive surfaces of the strips in the longitudinal direction in contact with each other.

Example 5

Cleaning Roller 5

A cleaning roller 5 is produced in the same manner as in Example 1 except that the end diameter is 50 μm and the angle θ is 15°.

Example 6

Cleaning Roller 6

A cleaning roller 6 is produced in the same manner as in Example 1 except that the spiral pitch R2 is 3 mm.

Example 7

Cleaning Roller 7

A cleaning roller 7 is produced in the same manner as in Example 1 except that the spiral pitch R2 is 2 mm.

Example 8

Cleaning Roller 8

A cleaning roller 8 is produced in the same manner as in Example 1 except that the spiral angle θ at which the strips each having the double-sided tape are wound around the core is 5°.

Example 9

Cleaning Roller 9

A cleaning roller 9 is produced in the same manner as in Example 1 except that the spiral angle θ at which the strips each having the double-sided tape are wound around the core is 4°.

Example 10

Cleaning Roller 10

A cleaning roller 10 is produced in the same manner as in Example 1 except that the spiral angle θ at which the strips each having the double-sided tape are wound around the core is 12°.

Example 11

Cleaning Roller 11

A cleaning roller 11 is produced in the same manner as in Example 1 except that the number of cells is 70.

Example 12

Cleaning Roller 12

A cleaning roller 12 is produced in the same manner as in Example 1 except that the number of cells is 80.

Example 13

Cleaning Roller 13

A cleaning roller 13 is produced in the same manner as in Example 1 except that the number of cells is 103.

Example 14

Cleaning Roller 14

A cleaning roller 14 is produced in the same manner as in Example 1 except that the number of cells is 110.

Example 15

Cleaning Roller 15

A cleaning roller 15 is produced in the same manner as in Example 1 except that the thickness of the foamed elastic layer is 0.8 mm.

Example 16

Cleaning Roller 16

A cleaning roller 16 is produced in the same manner as in Example 1 except that the thickness of the foamed elastic layer is 1.0 mm.

Example 17

Cleaning Roller 17

A cleaning roller 17 is produced in the same manner as in Example 1 except that the thickness of the foamed elastic layer is 3.0 mm.

Example 18

Cleaning Roller 18

A cleaning roller 18 is produced in the same manner as in Example 1 except that the thickness of the sponge foamed elastic layer is 3.3 mm.

Example 19

Cleaning Roller 19

A cleaning roller 19 is produced in the same manner as in Example 1 except that one strip is prepared from a urethane foam sheet having a thickness of 2.4 mm, and the prepared one strip having the double-sided tape is wound around the core in such a manner that the spiral pitch R2 is 10 mm.

Example 20

Cleaning Roller 20

A cleaning roller 20 is produced in the same manner as in Example 19 except that the spiral angle θ at which the strip having the double-sided tape is wound around the core is 25°.

Example 21

Cleaning Roller 21

A cleaning roller 21 is produced in the same manner as in Example 19 except that the spiral pitch R2 is 6 mm.

Example 22

Cleaning Roller 22

A cleaning roller 22 is produced in the same manner as in Example 19 except that the spiral angle θ at which the strip having the double-sided tape is wound around the core is 20°, and the spiral pitch R2 is 4 mm.

Example 23

Cleaning Roller 23

A cleaning roller 23 is produced in the same manner as in Example 19 except that the spiral angle θ at which the strip having the double-sided tape is wound around the core is 4°, and the spiral pitch R2 is 5 mm.

Comparative Example 1

Cleaning Roller C1

A cleaning roller C1 is produced in the same manner as in Example 20 except that a urethane foam sheet having a thickness of 2.4 mm (EP70S available from Inoac Corporation) is used.

Comparative Example 2

Cleaning Roller C2

A cleaning roller C2 is produced in the same manner as in Comparative Example 1 except that the spiral angle θ at which the strip having the double-sided tape is wound around the core is 15°, and a urethane foam sheet having an end diameter of 59 μm is used.

Comparative Example 3

Cleaning Roller C3

A cleaning roller C3 is produced in the same manner as in Example 19 except that the spiral angle θ at which the strip having the double-sided tape is wound around the core is 20°, and the spiral pitch R2 is 2 mm.

Evaluation

Cleaning Performance Evaluation

The cleaning roller shown in Table 1 and Table 2 and the produced charging roller 1 are disposed in a drum cartridge of an image forming apparatus "DocuCentre-VI C7771 available from Fuji Xerox Co., Ltd." in such a manner that the cleaning roller is in contact with the charging roller 1 at the displacement ratio shown in Table 1 and Table 2.

Next, an image quality pattern having 100% image density and having a strip shape 320 mm in length×30 mm in width in the output direction is printed on 20,000 sheets of A3 recording paper in an environment of 32° C. and 85% RH. The cleaning performance against adhesive substances is then evaluated by observing the surface condition of the charging roller 1 at the image quality pattern printing position.

The cleaning performance is evaluated on the basis of the following criteria by directly observing the surface of the charging roller with a confocal laser scanning microscope (OLS1100 available from Olympus Corporation). Cleaning Performance Evaluation: Evaluation Criteria G0: Adhesive substances are found in the range of 10% or less of the charging roller surface per $\mu m^2$.

G0.5: Adhesive substances are found in the range of more than 10% and 20% or less of the charging roller surface per $\mu m^2$.

G1: Adhesive substances are found in the range of more than 20% and 30% or less of the charging roller surface per $\mu m^2$.

G2: Adhesive substances are found in the range of more than 30% and 40% or less of the charging roller surface per $\mu m^2$.

G3: Adhesive substances are found in the range of more than 40% and 50% or less of the charging roller surface per $\mu m^2$.

Cleaning Maintainability Evaluation

After cleaning performance evaluation, the same image quality pattern is further printed on 50,000 sheets (printed on 70,000 sheets in total) in an environment of 10° C. and 15% RH by using the same cleaning roller and the same charging roller. The cleaning performance against adhesive substances is then evaluated by observing the surface condition in the same manner. The cleaning maintainability is evaluated on the basis of the following criteria by directly observing the surface of the charging roller with a confocal laser scanning microscope (OLS1100 available from Olympus Corporation).

Cleaning Maintainability Evaluation: Evaluation Criteria

G0: Adhesive substances are found in the range of 10% or less of the charging roller surface per $\mu m^2$.

G0.5: Adhesive substances are found in the range of more than 10% and 20% or less of the charging roller surface per $\mu m^2$.

G1: Adhesive substances are found in the range of more than 20% and 30% or less of the charging roller surface per $\mu m^2$.

G2: Adhesive substances are found in the range of more than 30% and 40% or less of the charging roller surface per $\mu m^2$.

G3: Adhesive substances are found in the range of more than 40% and 50% or less of the charging roller surface per $\mu m^2$.

The terms in Table 1 and Table 2 will be described below.

The "type of CLN-R" represents the type of cleaning roller.

The "end diameter" represents the equivalent circle diameter of an end portion of a cell skeleton protruding from the surface of the foamed elastic layer, and the unit is "μm".

The "R2" represents the spiral pitch R2, and the unit is "mm".

The "θ" represents the spiral angle θ, and the unit is "θ".

The "R2/θ" represents the ratio of the spiral pitch R2 to the spiral angle θ, that is, R2/θ.

The "number of cells" represents the number of cells in the foamed elastic layer, and the unit is "cells/25 mm".

The "thickness" represents the thickness of the foamed elastic layer, and the unit is "mm".

The "displacement ratio" represents the displacement ratio of the foamed elastic layer, and the unit is "%.

The "CLN performance evaluation" represents cleaning performance evaluation.

The "CLN maintainability evaluation" represents cleaning maintainability evaluation.

TABLE 1

| | Type of CLN-R | End Diameter (μm) | R2 (mm) | θ (°) | R2/θ | Number of Cells (cells/25 mm) | Thickness (mm) | Displacement Ratio (%) | CLN Performance Evaluation | CLN Maintainability Evaluation |
|---|---|---|---|---|---|---|---|---|---|---|
| Example 1 | 1 | 40 | 4 | 10 | 0.40 | 90 | 2.4 | 11 | G0 | G0 |
| | | | | | | | | 15 | G0 | G0 |
| | | | | | | | | 16 | G0 | G0.5 |
| Example 2 | 2 | 40 | 4 | 15 | 0.27 | 90 | 2.4 | 11 | G0 | G0.5 |
| Example 3 | 3 | 40 | 4 | 5 | 0.80 | 90 | 2.4 | 11 | G0 | G0 |
| Example 4 | 4 | 40 | 5 | 10 | 0.50 | 90 | 2.4 | 11 | G0 | G0 |
| Example 5 | 5 | 50 | 4 | 15 | 0.27 | 90 | 2.4 | 11 | G0 | G0 |
| Example 6 | 6 | 40 | 3 | 10 | 0.30 | 90 | 2.4 | 11 | G0 | G0 |
| Example 7 | 7 | 40 | 2 | 10 | 0.20 | 90 | 2.4 | 11 | G0.5 | G1 |
| Example 8 | 8 | 40 | 4 | 5 | 0.80 | 90 | 2.4 | 11 | G0 | G0 |
| Example 9 | 9 | 40 | 4 | 4 | 1.00 | 90 | 2.4 | 11 | G0 | G0.5 |
| Example 10 | 10 | 40 | 4 | 12 | 0.33 | 90 | 2.4 | 11 | G0 | G0.5 |
| Example 11 | 11 | 40 | 4 | 10 | 0.40 | 70 | 2.4 | 11 | G0 | G0.5 |
| Example 12 | 12 | 40 | 4 | 10 | 0.40 | 80 | 2.4 | 11 | G0 | G0 |
| Example 13 | 13 | 40 | 4 | 10 | 0.40 | 103 | 2.4 | 11 | G0 | G0 |
| Example 14 | 14 | 40 | 4 | 10 | 0.40 | 110 | 2.4 | 11 | G0 | G0.5 |
| Example 15 | 15 | 40 | 4 | 10 | 0.40 | 90 | 0.8 | 11 | G0 | G0.5 |
| Example 16 | 16 | 40 | 4 | 10 | 0.40 | 90 | 1.0 | 11 | G0 | G0 |
| Example 17 | 17 | 40 | 4 | 10 | 0.40 | 90 | 3.0 | 11 | G0 | G0 |
| Example 18 | 18 | 40 | 4 | 10 | 0.40 | 90 | 3.3 | 11 | G0 | G0.5 |
| Example 19 | 19 | 40 | 10 | 10 | 1.00 | 90 | 2.4 | 11 | G0.5 | G1 |
| | | | | | | | | 33 | G0.5 | G2 |
| Example 20 | 20 | 40 | 10 | 25 | 0.40 | 90 | 2.4 | 11 | G0.5 | G2 |
| Example 21 | 21 | 40 | 6 | 10 | 0.60 | 90 | 2.4 | 11 | G0 | G2 |
| Example 22 | 22 | 40 | 4 | 20 | 0.20 | 90 | 2.4 | 11 | G0 | G2 |
| Example 23 | 23 | 40 | 5 | 4 | 1.25 | 90 | 2.4 | 11 | G0 | G2 |

TABLE 2

| | Type of CLN-R | End Diameter (μm) | R2 (mm) | θ (°) | R2/θ | Number of Cells (cells/25 mm) | Thickness (mm) | Displacement Ratio (%) | CLN Performance Evaluation | CLN Maintainability Evaluation |
|---|---|---|---|---|---|---|---|---|---|---|
| Comparative Example 1 | C1 | 80 | 10 | 25 | 0.40 | 90 | 2.4 | 11 | G2 | G3 |
| Comparative Example 2 | C2 | 59 | 10 | 15 | 0.27 | 90 | 2.4 | 11 | G1 | G3 |
| Comparative Example 3 | C3 | 40 | 2 | 20 | 0.10 | 90 | 2.4 | 11 | G0.5 | G3 |

Example 24

Cleaning Roller 24

Four strips having a width of 4 mm and a length of 400 m are prepared by cutting a urethane foam sheet having a thickness of 2.4 mm (FHS available from Inoac Corporation) out into strips having a width of 4 mm and a length of 400 mm. A double-sided tape having a thickness of 0.05 mm (No. 5605 available from Nitto Denko Corporation) is stuck to the entire surface of each of the four cut-out strips to provide strips each having the double-sided tape.

The obtained four strips each having the double-sided tape are bundled and placed on a horizontal stage in such a manner that the release liner attached to the double-sided tape faces downward. An end portion of each strip in the longitudinal direction is pressed from above by using heated stainless steel in such a manner that the thickness of a section of each strip in the range of 1 mm long in the longitudinal direction from the end portion of the strip in the longitudinal direction is 15% of the thickness of the other section.

The obtained four strips each having the double-sided tape are placed on a horizontal stage in such a manner that the release liner attached to the double-sided tape faces upward. The strips each having the double-sided tape are wound around a metal core (material=SUM24EZ, outer diameter=Ø 5.0 mm) with tension in such a manner that the full length of the strips elongates by 0% to 5% and that the spiral pitch R2 is 4 mm and the spiral angle θ is 10° with the sides of the adhesive surfaces of the strips in the longitudinal direction in contact with each other. The cleaning roller 24 is produced accordingly.

The produced cleaning roller 24 is used as a cleaning roller for cleaning the surface of the sheet transport belt in the ink-jet recording apparatus. As a result, the surface of the transport belt is cleaned successfully.

The foregoing evaluation results indicate that the cleaning maintainability evaluation (i.e., cleaning maintainability) in Examples is better than that in Comparative Examples.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A cleaning body comprising:

a core; and a foamed elastic layer spirally wound around an outer circumferential surface of the core from one end of the core to the other end, wherein an end portion of a cell skeleton protruding from a surface of the foamed elastic layer has an equivalent circle diameter of 50 μm or less, and the foamed elastic layer has a spiral pitch R2 of 5 mm or less and a spiral angle θ of 15° or less.

2. The cleaning body according to claim 1, wherein the end portion of the cell skeleton protruding from the surface of the foamed elastic layer has an equivalent circle diameter of 35 μm or more and 45 μm or less, and the foamed elastic layer has a spiral pitch R2 of 3 mm or more and 4 mm or less and a spiral angle θ of 5° or more and 10° or less.

3. The cleaning body according to claim 2, wherein the number of cells in the foamed elastic layer is 80 cells/25 mm or more and 105 cells/25 mm or less.

4. The cleaning body according to claim 1, wherein the foamed elastic layer has a thickness of 1.0 mm or more and 3.0 mm or less.

5. An assembly comprising:

a body to be charged;

a charging body that charges the body to be charged and rotates; and the cleaning body according to claim 1 that cleans the charging body while rotating in contact with the rotating charging body, wherein the body to be charged, the charging body, and the cleaning body are assembled so as to be integrally attachable to and detachable from an apparatus body.

6. The assembly according to claim 5, wherein the foamed elastic layer of the cleaning body in contact with the charging body exhibits a displacement ratio of 15% or less.

7. An image forming apparatus comprising:

an image carrier that can carry an image;

a charging body that charges the image carrier and rotates;

an exposure device that exposes the image carrier charged by the charging body to form an electrostatic latent image;

a developing device that develops the electrostatic latent image formed on the image carrier by the exposure device; and the cleaning body according to claim 1 that cleans the charging body while rotating in contact with the rotating charging body.

8. The image forming apparatus according to claim 7, wherein the foamed elastic layer of the cleaning body in contact with the charging body exhibits a displacement ratio of 15% or less.

9. A cleaning body comprising:

a core; and a foamed elastic layer spirally wound around an outer circumferential surface of the core from one end of the core to the other end, wherein an end portion of a cell skeleton protruding from a surface of the foamed elastic layer has an equivalent circle diameter of 50 μm or less, and a spiral pitch R2 and a spiral angle θ of the foamed elastic layer satisfy a relationship of $0.2 \leq R2/\theta \leq 1.0$.

10. The cleaning body according to claim 9, wherein the spiral pitch R2 and the spiral angle θ of the foamed elastic layer satisfy a relationship of $0.4 \leq R2/\theta \leq 0.8$.

11. The cleaning body according to claim 9, wherein the end portion of the cell skeleton protruding from the surface of the foamed elastic layer has an equivalent circle diameter of 35 μm or more and 45 μm or less.

12. An assembly comprising:

a body to be charged;

a charging body that charges the body to be charged and rotates; and the cleaning body according to claim 9 that cleans the charging body while rotating in contact with the rotating charging body, wherein the body to be charged, the charging body, and the cleaning body are assembled so as to be integrally attachable to and detachable from an apparatus body.

13. The assembly according to claim 12, wherein the foamed elastic layer of the cleaning body in contact with the charging body exhibits a displacement ratio of 15% or less.

14. An image forming apparatus comprising:

an image carrier that can carry an image;

a charging body that charges the image carrier and rotates;

an exposure device that exposes the image carrier charged by the charging body to form an electrostatic latent image;

a developing device that develops the electrostatic latent image formed on the image carrier by the exposure device; and the cleaning body according to claim 9 that cleans the charging body while rotating in contact with the rotating charging body.

15. The image forming apparatus according to claim 14, wherein the foamed elastic layer of the cleaning body in contact with the charging body exhibits a displacement ratio of 15% or less.

* * * * *